US009957628B2

(12) United States Patent
Prado Pueo

(10) Patent No.: US 9,957,628 B2
(45) Date of Patent: May 1, 2018

(54) SYSTEM FOR EVALUATION OF CURRENT DISTRIBUTION IN ELECTRODES OF ELECTROCHEMICAL PLANTS

(71) Applicant: INDUSTRIE DE NORA S.P.A., Milan (IT)

(72) Inventor: Felix Prado Pueo, Monzon (ES)

(73) Assignee: INDUSTRIE DE NORA S.P.A., Milan (IT)

( * ) Notice: Subject to any disclaimer, the term of this patent is extended or adjusted under 35 U.S.C. 154(b) by 345 days.

(21) Appl. No.: 14/893,283

(22) PCT Filed: Jun. 17, 2014

(86) PCT No.: PCT/EP2014/062700
§ 371 (c)(1),
(2) Date: Nov. 23, 2015

(87) PCT Pub. No.: WO2014/202592
PCT Pub. Date: Dec. 24, 2014

(65) Prior Publication Data

US 2016/0115608 A1 Apr. 28, 2016

(30) Foreign Application Priority Data

Jun. 17, 2013 (IT) ..... MI2013A0991

(51) Int. Cl.
*C25C 1/12* (2006.01)
*C25C 7/06* (2006.01)
*C25C 7/02* (2006.01)

(52) U.S. Cl.
CPC ..... *C25C 7/06* (2013.01); *C25C 1/12* (2013.01); *C25C 7/02* (2013.01)

(58) Field of Classification Search
None
See application file for complete search history.

(56) References Cited

U.S. PATENT DOCUMENTS

| | | | | |
|---|---|---|---|---|
| 2010/0258435 | A1 | 10/2010 | Vidaurre Heiremans | |
| 2012/0205254 | A1 | 8/2012 | Garcia Navarro et al. | |
| 2013/0126337 | A1 | 5/2013 | Grant | |
| 2016/0002802 | A1* | 1/2016 | Grant | C25C 1/12 205/771 |

FOREIGN PATENT DOCUMENTS

WO 201123896 A1 10/2011

OTHER PUBLICATIONS

International Search Report based on International Application No. PCT/EP2014/062700.

* cited by examiner

*Primary Examiner* — Arun S Phasge
(74) *Attorney, Agent, or Firm* — Lucas & Mercanti, LLP

(57) ABSTRACT

The present invention relates to a system for direct detection of current supplied to the electrodes of electrolytic cells, particularly useful in non-ferrous metal electrowinning or electrorefining plants. The current distribution on a practically unlimited number of electrodes can be obtained through direct measurement on the electrode hanging bars without requiring the manual intervention of plant staff.

9 Claims, 2 Drawing Sheets

SYSTEM FOR EVALUATION OF CURRENT DISTRIBUTION IN ELECTRODES OF ELECTROCHEMICAL PLANTS

CROSS-REFERENCE TO RELATED APPLICATIONS

This application is a U.S. national stage of PCT/EP2014/062700 filed on Jun. 17, 2014 which claims the benefit of priority from Italian Patent Application No. MI2013A000991 filed Jun. 17, 2013, the contents of each of which are incorporated herein by reference.

FIELD OF THE INVENTION

The invention relates to a system for direct detection of current supplied to the electrodes of electrolytic cells used in particular in non-ferrous metal electrowinning or electrorefining plants.

BACKGROUND OF THE INVENTION

The current supplied to cells used in electrochemical plants, especially in plants of metal electrodeposition such as metal electrowinning or electrorefining may be apportioned in a very diverse manner to the various electrodes installed, with negative consequences on production. This phenomenon can occur for several reasons. For example, in the particular case of metal electrowinning or electrorefining plants, the electrodes of negative polarity (cathodes) are frequently removed from their seats to allow harvesting of the product deposited thereon, to be later put back in place for the following production cycle. This frequent handling, generally carried out on a very high number of cathodes, often leads to an imperfect repositioning on the relative bus-bars and to less than ideal electrical contacts, which can also be occasioned by fouling deposited in the receiving seats. It is also possible that the deposition of the product takes place in an irregular manner on the electrode, with formation of mass transport gradients altering the profile of the cathode surface. When this occurs, an electrical imbalance is established due to the fact that the anode-to-cathode gap is no longer constant along the whole electrode surface: the electrical resistance, being a function of the distance between each pair of anodes and cathodes, becomes variable, worsening the problem of irregular current distribution.

The current, therefore, might be apportioned in different amounts to each electrode due both to bad electrical contacts between the latter and the bus-bars and because of alterations of the surface profile of the cathodes. Moreover, even the simple wear of the anodes can affect the distribution of current.

These inhomogeneities in the distribution of current can lead to anode-to-cathode short-circuits. Another frequent cause of short-circuits, particularly in the case of copper electrodeposition, is the occasional formation of dendritic deposits that grow locally at faster rate as long as the local anode-to-cathode gap decreases, with an increasing fraction of current that concentrates at the point of growth of the dendrite, until the onset of a short-circuit condition between the cathode and the anode occurs. In case of short-circuit, the current tends to concentrate on the shorted cathode, subtracting current to the remaining cathodes and seriously hampering the production, which cannot be resumed until the shorted cathode is disconnected.

An uneven current distribution, besides generating a loss of quality and production capacity, as indicated above, puts at risk the integrity of advanced anodes obtained from titanium meshes, shortening their lifetime.

In industrial plants, given the high number of cells and electrodes present, the task of detecting irregularities in the distribution of current is very complex. Such detection, in fact, involves thousands of manual measurements performed by operators via infrared or magnetic detectors. In the specific case of metal electrowinning and electrorefining plants, these detections are carried out by the operator in a high temperature environment and in the presence of acid mists, mainly containing sulphuric acid.

Moreover, conventional manual elements used by operators, such as gaussmeters or instruments with infrared sensors, allow to locate only large imbalances of current distribution, since they actually detect imbalances associated with changes in the magnetic field or temperature.

These manual or semi-manual systems have the disadvantage of being unsuitable for continuous operation (only allowing spot checks), very expensive and potentially hazardous for the operator's health.

There are known systems for wireless monitoring of the cells which, although being permanent and working in continuous, only detect changes in voltage and temperature for each cell and not for every single electrode. This information, as explained above, is imprecise and overall insufficient.

An attempt to overcome the above problems is disclosed for example in WO2013037899. The invention described in such patent application has the disadvantage of entailing the fixing of thousands of contacts directly on the bus-bars, a complicated task to accomplish in a plant during operation. Furthermore, such indirect current measurement requires the use of a complicated calculation model that needs to allow for several approximations.

For these reasons, there is a need expressed by the industry to get hold of a technically and economically feasible system for permanently and continuously monitoring and measuring current distribution in each and every electrode installed in the cells of a metal electrodeposition plant.

SUMMARY OF THE INVENTION

The present invention allows detecting current distribution of a virtually unlimited number of electrodes installed in electrochemical plants, for example in non-ferrous metal electrolytic deposition plants (e.g. electrolytic extraction, or electrowinning, and electrolytic refining, or electrorefining) without requiring the intervention of operators to carry out manual measurements in unhealthy environments and capable of signalling of the malfunctioning of one or more specific electrodes by means of an alerting system. The invention also allows overcoming the complexity of calculation and installation of the indirect measurement systems of the prior art, the system being suitable for direct installation on the electrode during the manufacturing phase of the latter.

Various aspects of the invention are set out in the accompanying claims.

Under one aspect, the invention relates to a system for evaluation of current distribution in cathodes and anodes of a metal electrodeposition plant, said system comprising:

- at least one electrolysis cell containing an electrolyte;
- a current bus-bar associated with said at least one electrolysis cell;
- a multiplicity of cathodes and anodes in electrical contact with and surmounted by cathodic and anodic hanger bars of homogeneous resistivity and regular geometry, said hanger bars having a terminal part abutting said current bus-bar and being suitable for holding the corresponding cathodes and anodes in position inside said at least one electrolysis cell;

wherein said cathodic and anodic hanger bars are equipped with at least one electrical probe connected with at least two contact detection points located on said cathodic and anodic hanger bars in the region delimited by the electrical connection with the current bus-bar and the first electrical connection with the corresponding cathode or anode.

The term "first electrical connection" between the cathodic and anodic hanger bars and the electrode (cathode or anode, respectively) connected therewith is used herein to designate the first point of contact reached by the electric current starting from its side of origin.

The inventors have found that when the geometry of the electrode hanger bar is regular, from this measure it is possible to infer the current distribution on the electrode coupled to the electrode hanger bar.

There are known in the art electrochemical metal deposition plants wherein the cells are configured to receive current from one side only or are equipped with balance secondary current bus-bars for current redistribution. In the latter case, the system of the invention is arranged so as to comprise:

at least one electrolysis cell containing an electrolyte;

a current bus-bar associated with said at least one electrolysis cell;

a balance secondary bus-bar;

a multiplicity of cathodes and anodes in electrical contact with and surmounted by cathodic and anodic hanger bars of homogeneous resistivity and regular geometry, said hanger bars having a first terminal part abutting said current bus-bar and a second terminal part abutting said balance secondary bus bar, said hanger bars being suitable for holding the corresponding cathodes and anodes in position inside said at least one electrolysis cell;

wherein said cathodic and anodic hanger bars are equipped with at least one electrical probe connected with at least four contact detection points located on said cathodic and anodic hanger bars in the regions delimited by the electrical connections with the current and balance secondary bus-bar respectively and the first electrical connection with the corresponding cathode or anode.

In one embodiment of the system according to the invention said cathodic and anodic hanger bars are equipped with at least one microcircuit having a microprocessor connected thereto, said microcircuit electrically connected with said contact detection points.

To avoid connecting the electrode hanger bars with a plurality of cables, which is a complex operation for plant managers, the ohmic drop measurements can be transmitted to the central computer for the necessary processing via radio transmitter. For this reason, a further embodiment of the system according to the invention provides the microcircuit of the microprocessor to be also equipped with a radio transmitter. In some cases, the resistivity of the electrode hanger bars may be affected by local variations in temperature associated with particularly critical operating conditions. The necessary correction is made possible by a further embodiment of the system according to the invention providing said contact detection points to be connected to a temperature sensor device.

In a further embodiment of the system according to the invention the contacts detection points of the hanger bars, the radio transmitter and the temperature sensor device are protected from the surrounding chemical environment by means of chemically resistant resins, for example epoxy resins.

Under another aspect, the invention relates to a method for evaluating current distribution in cathodes and anodes of a metal electrodeposition plant comprising the steps of:

equipping said hanger bars with at least one electrical probe electrically connected with at least two contact detection points located on said cathodic and anodic hanger bars in the region delimited by the electrical connection with the current bus-bar and the first electrical connection with the corresponding cathode or anode;

calibrating the resistances of the cathodic and anodic hanger bars;

transmitting current measurements to a central computer by means of cables or radio transmitter;

elaborating data through the central computer;

actuating an alert system connected to the central computer in the event of predefined anomalies;

actuating optional means for disconnecting electrodes presenting anomalies.

Under a further aspect the invention relates to a cathodic or anodic hanger bar for electrodeposition applications having homogeneous resistivity, a regular geometry and equipped with at least one microcircuit provided with a microprocessor, said microcircuit being connected with at least two detection points located in the region delimited by the electrical connection with a current bus-bar and the first electrical connection with a corresponding cathode or anode, said microcircuit having an internal resistive circuit.

Under a further aspect the invention relates to a method for evaluating current distribution in cathodes and anodes of a metal electrodeposition plant, comprising the steps of:

applying a microcircuit having a microprocessor integrated therewith on each cathodic and anodic hanger bar by electrically connecting it to at least two contact detection points located on each of the cathodic and anodic hanger bars in the region delimited by the electrical connection with the respective current bus-bar and the first electrical connection with the corresponding cathode or anode;

calibrating the resistances of the cathodic and anodic hanger bars;

transmitting current measurements to a central computer by means of cables or radio transmitter;

processing data through the central computer;

actuating an alert system connected to the central computer in the event of predefined anomalies;

actuating means for disconnecting electrodes presenting anomalies.

Some implementations exemplifying the invention will now be described with reference to the attached drawings, which have the sole purpose of illustrating the reciprocal arrangement of the different elements relatively to said particular implementations of the invention; in particular, drawings are not necessarily drawn to scale.

DETAILED DESCRIPTION OF THE DRAWINGS

Figure 1:
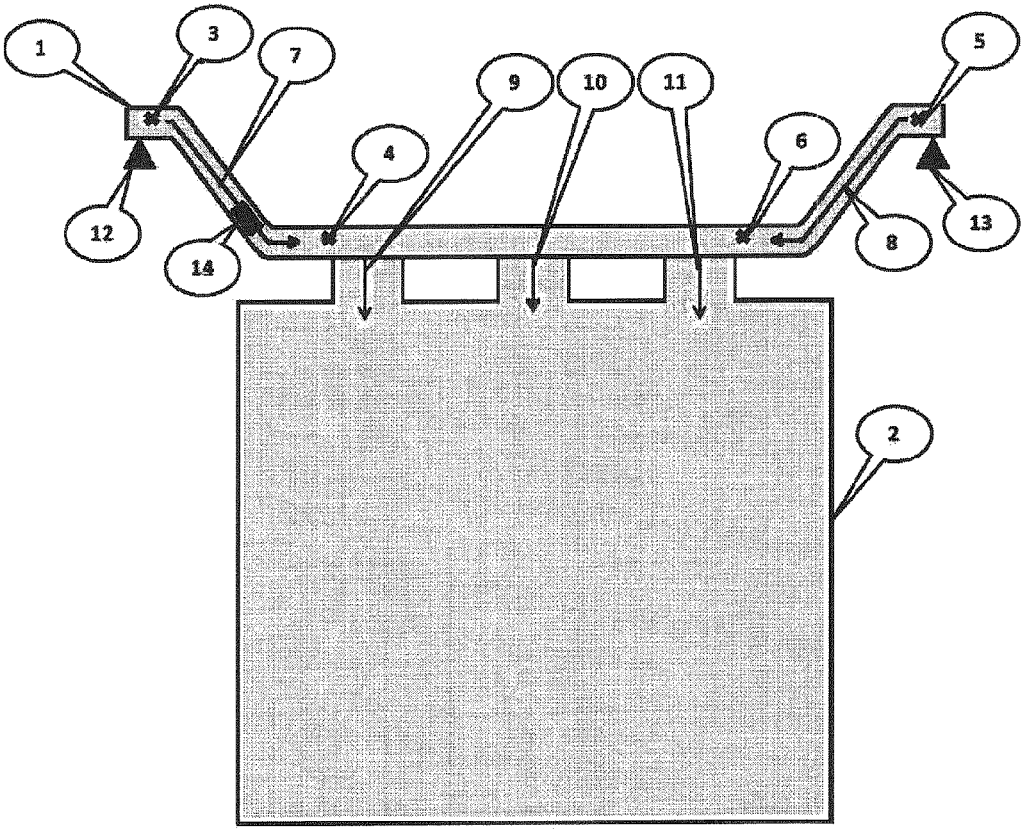
FIG. 1 shows a schematic view of an electrode-to-electrode hanger bar coupling according to the invention in a configuration of double electrical contact.

In FIG. 1 there is shown an electrode hanger bar 1, an electrode 2 attached thereto, detection points 3, 4, 5 and 6, directions of current 7, 8, 9, 10 and 11, current bus-bars 12 and 13, microcircuit equipped with microprocessor 14.

Figure 2:
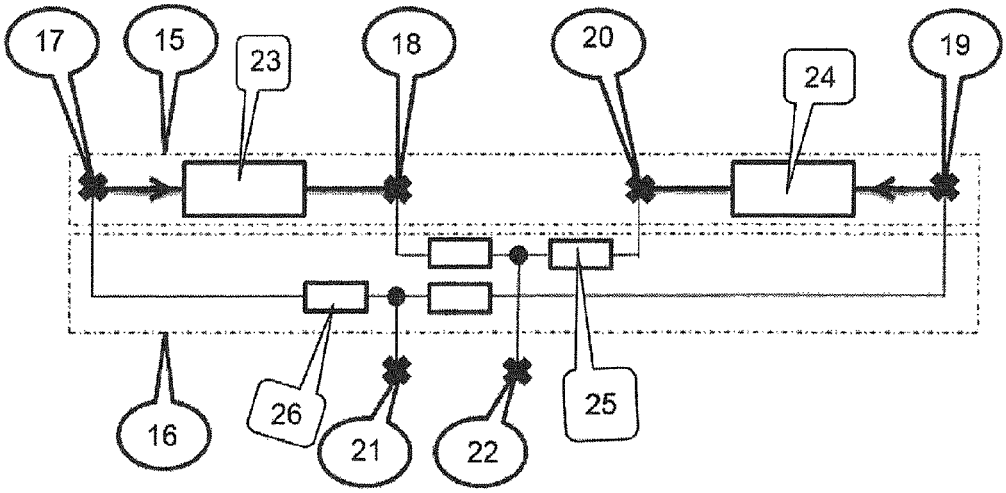
FIG. 2 shows a scheme of an electric microcircuit according to the invention in a configuration of double electrical contact.

In FIG. 2 there is shown a scheme of electric microcircuit indicating the area 15 corresponding to a circuit equivalent to the electrical circuit of electrode hanger bar of FIG. 1, the area 16 corresponding to the electrical circuit of the microcircuit, detection points 17, 18, 19 and 20, electric resistances corresponding to fractions of electrode hanger bar 23 and 24, measurement points of the potential difference of microcircuit 21 and 22, applied resistors 25 and 26.

The following example is included to demonstrate particular embodiments of the invention, whose practicability has been largely verified in the claimed range of values. It should be appreciated by those of skill in the art that the compositions and techniques disclosed in the example which follows represent compositions and techniques discovered by the inventors to function well in the practice of the invention; however, those of skill in the art should, in light of the present disclosure, appreciate that many changes can be made in the specific embodiments which are disclosed and still obtain a like or similar result without departing from the scope of the invention.

EXAMPLE

A system for evaluating the current distribution of cathodes and anodes was assembled by applying a circuit according to the scheme of FIG. 2. The method used to calculate the current apportionment in this specific case is based on the model expressed by the following formulas. A is the voltage at point 17, C the voltage at point 19, B the voltage at point 18 and D the voltage at point 20. M is the voltage at point 21 and N the voltage at point 22. K is the resistance of electrode hanger bar corresponding to the section between points 17 and 18. P*K is the resistance of the electrode hanger bar corresponding to the section between points 19 and 20. R is the value of the resistors installed between points 17 and 21 and points 18 and 22, respectively. P*R are the resistances installed between points 19 and 21, and 20 and 22. I1 is the current between points 17 and 18 and I2 is the current between points 19 and 20.

$$M - C = \frac{P \cdot R}{R + P \cdot R}(A - C)$$

$$M = \frac{P \cdot R}{R + P \cdot R}(A - C) + C$$

$$N - D = \frac{P \cdot R}{R + P \cdot R}(B - D)$$

$$N = \frac{P \cdot R}{R + P \cdot R}(B - D) + D$$

$$M - N = \frac{P \cdot R}{R + P \cdot R}(A - C) + C - \left(\frac{P \cdot R}{R + P \cdot R}(B - D) + D\right)$$

$$M - N = (C - D) + \frac{P \cdot R}{R + P \cdot R}(A - C) - \frac{P \cdot R}{R + P \cdot R}(B - D)$$

-continued $$M - N = (C - D) + \frac{P}{1 + P}(A - C) - \frac{P}{1 + P}(B - D)$$

$$M - N = C - D + \frac{P \cdot A}{1 + P} - \frac{P \cdot C}{1 + P} - \frac{P \cdot B}{1 + P} + \frac{P \cdot D}{1 + P}$$

$$M - N = (C - D) - (C - D)\frac{P}{1 + P} + \frac{P \cdot A}{1 + P} - \frac{P \cdot B}{1 + P}$$

$$M - N = (C - D)\left(1 - \frac{P}{1 + P}\right) + \frac{P \cdot A}{1 + P} - \frac{P \cdot B}{1 + P}$$

$$M - N = (C - D)\frac{1}{1 + P} + (A - B)\frac{P}{1 + P}$$

$$M - N = I1 \cdot K\frac{P}{1 + P} + I2 \cdot P \cdot K\frac{1}{1 + P}$$

$$M - N = I1 \cdot K\frac{P}{1 + P} + I2 \cdot K\frac{P}{1 + P}$$

$$M - N = K \cdot \frac{P}{1 + P}(I1 + I2)$$

The potential difference between points M–N is hence proportional to (I1+I2). By knowing I total it is therefore possible to derive R equal to R1, R2 . . . Rn, and thus the individual currents.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

The invention claimed is:

1. A system for evaluation of current distribution in cathodes and anodes of a metal electrodeposition plant, the system comprising:

at least one electrolysis cell containing an electrolyte;

a current bus-bar associated with said at least one electrolysis cell;

a balance secondary bus-bar;

a multiplicity of cathodes and anodes surmounted by cathodic and anodic hanger bars of homogeneous resistivity and regular geometry in electrical contact therewith, said hanger bars having a first terminal part abutting said current bus-bar and a second terminal part abutting said balance secondary bus bar, said hanger bars being suitable for holding the corresponding cathodes and anodes in position inside said at least one electrolysis cell;

wherein said cathodic and anodic hanger bars are equipped with at least one electrical probe connected with at least four contact detection points located on said cathodic and anodic hanger bars in the regions delimited by the electrical connections with the current and balance secondary bus-bar respectively and the first electrical connection with the corresponding cathode or anode.

2. The system according to claim 1, wherein said cathodic and anodic hanger bars are equipped with at least one microcircuit having a microprocessor connected therewith, said microcircuit electrically connected with said contact detection points.

3. The system according to claim 2, wherein said at least one microcircuit is equipped with a radio transmitter.

4. The system according to claim 1 wherein said contact detection points are connected to a temperature sensor device.

5. The system according to claim 1 wherein said cathodic and anodic hanger bars are equipped with at least one microcircuit having said microprocessor integrated therewith.

6. The system according to claim 5 wherein said microcircuit having said microprocessor integrated therewith, said contacts detection points of the hanger bars, said radio transmitter and said temperature sensor device are protected from the surrounding chemical environment by means of chemically resistant resins.

7. A method for evaluating current distribution in cathodes and anodes of a metal electrodeposition plant, said cathodes and anodes being surmounted by corresponding hanger bars, wherein the method comprises the steps of:

equipping said hanger bars with at least one electrical probe by electrically connecting it with at least four contact detection points located on said cathodic and anodic hanger bars in the regions delimited by the electrical connections with a current bus-bar and a balance secondary bus-bar, respectively and the first electrical connection with the corresponding cathode or anode;

calibrating the resistances of the cathodic and anodic hanger bars;

transmitting current measurements to a central computer by means of cables or radio transmitter;

elaborating data through said central computer;

actuating an alert system connected to said central computer in the event of predefined anomalies;

actuating optional means for disconnecting electrodes presenting anomalies.

8. Cathodic or anodic hanger bar for electrodeposition applications having homogeneous resistivity and regular geometry and having at least one microcircuit provided with a microprocessor connected therewith, said microcircuit being connected with at least four detection points located in the regions delimited by the electrical connections with a current bus-bar and a balance secondary bus-bar respectively and the first electrical connection with a corresponding cathode or anode, said microcircuit having an internal resistive circuit.

9. A method for evaluating current distribution in cathodes and anodes of a metal electrodeposition plant, said cathodes and anodes being surmounted by corresponding hanger bars, wherein the method comprises the steps of:

applying a microcircuit having a microprocessor integrated therewith on each cathodic and anodic hanger bar by electrically connecting it to at least four contact detection points located on each of the cathodic and anodic hanger bars in the regions delimited by the electrical connections with a current bus-bar and a balance secondary bus-bar respectively and the first electrical connection with the corresponding cathode or anode;

calibrating the resistances of the cathodic and anodic hanger bars;

transmitting current measurements to a central computer by means of cables or radio transmitter;

elaborating data through said central computer;

actuating an alert system connected to said central computer in the event of predefined anomalies;

actuating optional means for disconnecting electrodes presenting anomalies.

* * * * *